US008216761B2

(12) United States Patent
Jang et al.

(10) Patent No.: US 8,216,761 B2
(45) Date of Patent: Jul. 10, 2012

(54) METHOD OF PRODUCING POLYMERIZED TONER

(75) Inventors: Wook Jang, Daejeon (KR); Chang Soon Lee, Daejeon (KR); Woo Cheul Jeong, Ulsan (KR); Ji Hoon Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 365 days.

(21) Appl. No.: 12/671,416

(22) PCT Filed: Oct. 8, 2008

(86) PCT No.: PCT/KR2008/005910

§ 371 (c)(1),
(2), (4) Date: Jan. 29, 2010

(87) PCT Pub. No.: WO2009/054624

PCT Pub. Date: Apr. 30, 2009

(65) Prior Publication Data

US 2010/0190103 A1 Jul. 29, 2010

(30) Foreign Application Priority Data

Oct. 22, 2007 (KR) ..... 10-2007-0105919
Oct. 22, 2007 (KR) ..... 10-2007-0105981

(51) Int. Cl.
*G03G 5/00* (2006.01)

(52) U.S. Cl. ..... 430/137.15; 430/137.1

(58) Field of Classification Search ..... 430/137.1, 430/137.15
See application file for complete search history.

(56) References Cited

U.S. PATENT DOCUMENTS

2006/0099530 A1* 5/2006 Lee et al. ..... 430/137.15
2006/0276577 A1* 12/2006 Lee et al. ..... 524/403

FOREIGN PATENT DOCUMENTS

JP 07-092736 A 4/1995
KR 10-2004-0074709 A 8/2004
KR 10-2005-0098662 A 10/2005
KR 10-2006-0041017 A 5/2006

* cited by examiner

*Primary Examiner* — Mark F Huff
*Assistant Examiner* — Stewart Fraser
(74) *Attorney, Agent, or Firm* — Rothwell, Figg, Ernst & Manbeck, P.C.

(57) ABSTRACT

Disclosed is a method for producing a polymerized toner. In the method, a mixture of colloidal silica as an aqueous dispersant and a polyvinylpyrrolidone is used during suspension polymerization. The amount of polyvinylpyrrolidone/colloidal silica aggregates having a diameter smaller than 100 nm is also limited to 1% by weight or less, based on the total weight of all aggregates. A polymerized toner produced by the method has a volume average particle diameter (dv) of 5 to 10 μm and a volume average particle diameter/number average particle diameter ratio (dv/dp) of 1.5 or less. The polymerized toner is consumed in a small amount during printing. According to the method, the formation of emulsion particles having a size smaller than 0.5 μm is inhibited.

21 Claims, No Drawings

METHOD OF PRODUCING POLYMERIZED TONER

CROSS REFERENCE TO RELATED APPLICATIONS

This application is a 35 U.S.C. §371 National Phase Entry Application from PCT/KR2008/005910, filed Oct. 8, 2008, and designating the United States, which claims priority under 35 U.S.C. §119 to Korean Patent Application No. 10-2007-0105919 filed Oct. 22, 2007, and to Korean Patent Application No. 10-2007-0105981 filed Oct. 22, 2007, which are incorporated herein in their entireties.

TECHNICAL FIELD

The present invention relates to a method for producing a polymerized toner, and more specifically to a method for producing a polymerized toner using aggregates of a polyvinylpyrrolidone and colloidal silica in an aqueous medium as a dispersant.

BACKGROUND ART

Toners are used for the development of electrophotographic images and in a variety of electrostatic printers and copiers. Toners refer to coating substances that can be transferred and fixed to objects to form desired patterns thereon. As computer-aided documentation has been generalized in recent years, there has been a rapidly increasing demand for imaging apparatuses, such as printers. In response to this demand, the use of toners is also on the rise.

Methods for the production of toners are largely classified into two types, i.e. methods based on pulverization and polymerization. The first type of methods based on pulverization is most widely known. According to a typical method based on pulverization, a resin and a pigment are melt-mixed (or extruded), pulverized and sorted on the basis of size to obtain toner particles. However, the toner particles thus obtained have a broad particle diameter distribution and are very irregular in shape (e.g., sharp-edged), which are disadvantageous in terms of electrical conductivity and flowability.

To overcome the above disadvantages of the first type of methods, the second type of methods based on polymerization for the production of spherical toner particles has been proposed. It is known that the second type of methods can be carried out by emulsion polymerization/aggregation and suspension polymerization. According to emulsion polymerization, the size distribution of particles is difficult to control and the reproducibility of toner quality remains problematic. For these reasons, suspension polymerization is predominantly employed in preference to emulsion polymerization.

However, toner particles produced by suspension polymerization also have a broad size distribution and tend to partially aggregate during polymerization. That is, the production of toner particles by suspension polymerization involves an additional separation step by centrifugation after polymerization, resulting in low yield.

DISCLOSURE

Technical Problem

The present invention has been made in view of the above problems, and it is an object of the present invention to provide a method for producing a polymerized toner that has a preferred volume average particle diameter, has a narrow particle size distribution, shows no tendency to partially aggregate during polymerization, which eliminates the need for centrifugation after polymerization, and is consumed in a small amount during printing.

Technical Solution

In order to accomplish the object of the present invention, there is provided a method for producing a toner whose volume average particle diameter (dv) is from 5 to 10 μm and volume average particle diameter/number average particle diameter ratio (dv/dp) is 1.5 or less by suspension polymerization, the method being characterized by the use of aggregates of colloidal silica and a polyvinylpyrrolidone during suspension polymerization as an aqueous dispersant.

Specifically, the method of the present invention comprises the following steps:

(1) dispersing a polyvinylpyrrolidone and colloidal silica in an aqueous medium to prepare an aqueous dispersion;

(2) preparing a mixture of monomers;

(3) mixing the aqueous dispersion with the monomer mixture; and (4) polymerizing the monomers.

In step (1), the aqueous dispersion may contain polyvinylpyrrolidone/colloidal silica aggregates having a diameter smaller than 100 nm in an amount of 1% by weight or less, based on the total weight of all aggregates. That is, polyvinylpyrrolidone/colloidal silica aggregates having a diameter smaller than 100 nm are substantially removed from the aqueous dispersion.

The polyvinylpyrrolidone/colloidal silica aggregates having a diameter smaller than 100 nm are removed by mixing the colloidal silica and the polyvinylpyrrolidone with stirring at a high speed, standing the mixture for a certain time, and removing the supernatant.

The supernatant is present in an amount of 40 to 60 parts by weight, based on 100 parts by weight of the aqueous dispersion.

The colloidal silica has a volume average particle diameter (dv) of 10 to 30 nm and a volume average particle diameter/number average particle diameter ratio (dv/dp) lower than 1.5.

The polyvinylpyrrolidone has a molecular weight of 20,000 to 60,000.

The colloidal silica is used in an amount of 5 to 15 parts by weight, based on 100 parts by weight of all monomers used.

The polyvinylpyrrolidone is used in an amount of 1 to 3 parts by weight, based on 100 parts by weight of all monomers used.

The method of the present invention may further comprise removing the polyvinylpyrrolidone and the colloidal silica after step (4).

The polyvinylpyrrolidone and the colloidal silica are separated from the toner surface by the addition of a 0.05 to 0.2 N aqueous NaOH solution.

The monomer mixture is used in an amount of 1 to 60 parts by weight, based on 100 parts by weight of the aqueous dispersion. The monomer mixture includes 30 to 95 parts by weight of an aromatic vinyl monomer, 5 to 70 parts by weight of at least one monomer selected from the group consisting of acrylate, methacrylate and diene monomers, 1 to 20 parts by weight of a pigment, 0.1 to 30 parts by weight of a wax, 0.001 to 10 parts by weight of a crosslinking agent, 0.1 to 20 parts by weight of a charge control agent, and 0.001 to 8 parts by weight of a molecular weight modifier, based on 100 parts by weight of all monomers used.

The monomer mixture may further include 0.01 to 10 parts by weight of at least one polar polymer selected from polyesters and styrene-acrylate polymers, based on 100 parts by weight of all monomers used.

The monomer mixture may further include 0.1 to 30 parts by weight of an acidic or basic olefin monomer, based on 100 parts by weight of all monomers used.

The aromatic vinyl monomer is selected from the group consisting of styrene, monochlorostyrene, methylstyrene and dimethylstyrene.

The acrylate monomer is selected from the group consisting of methyl acrylate, ethyl acrylate, n-butyl acrylate, isobutyl acrylate, dodecyl acrylate and 2-ethylhexyl acrylate; the methacrylate monomer is selected from the group consisting of methyl methacrylate, ethyl methacrylate, n-butyl methacrylate, isobutyl methacrylate, dodecyl methacrylate and 2-ethylhexyl methacrylate; and the diene monomer is selected from the group consisting of butadiene and isoprene.

The wax is selected from: petroleum waxes, including paraffin wax, microcrystalline wax and ceresin wax; natural waxes, including carnauba wax; synthetic waxes, including ester wax, polyethylene wax and polypropylene wax; and mixtures thereof.

The molecular weight modifier is selected from mercaptan compounds, including t-dodecyl mercaptan and n-dodecyl mercaptan, and mixtures thereof.

The pigment is selected from: inorganic pigments, including metal powder, metal oxide, carbon, sulfide, chromate and ferrocyanide pigments; organic pigments, including azo dye, acidic dye, basic dye, mordant dye, phthalocyanine, quinacridone and dioxane pigments; and mixtures thereof.

The charge control agent is selected from: cationic charge control agents, including higher aliphatic metal salts, alkoxyamines, chelates, quaternary ammonium salts, alkylamides, fluorinated activators and naphthenic acid metal salts; anionic charge control agents, including chlorinated paraffin, chlorinated polyesters, acid group-containing polyesters, sulfonylamines of copper phthalocyanine and styrene-acrylate polymers having sulfonic acid groups; and mixtures thereof.

The crosslinking agent is selected from the group consisting of divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine and tetraallyloxyethane.

The monomer mixture may further include 0.01 to 5 parts by weight of a reaction initiator, based on 100 parts by weight of all monomers used.

The reaction initiator is selected from the group consisting of: azo initiators, including azobisisobutyronitrile and azobisvaleronitrile; organic peroxides, including benzoyl peroxide and lauroyl peroxide; potassium persulfate; and ammonium persulfate.

The monomer mixture is homogenized with the aqueous dispersion under a shear force using a homogenizer before polymerization.

Advantageous Effects

The method of the present invention does not involve centrifugation after polymerization. In addition, a polymerized toner produced by the method of the present invention is consumed in a small amount during printing. Furthermore, according to the method of the present invention, the formation of emulsion particles after polymerization is effectively inhibited.

BEST MODE

The present invention provides a method for producing a toner which comprises (1) dispersing a polyvinylpyrrolidone and colloidal silica in an aqueous medium to prepare an aqueous dispersion, (2) preparing a mixture of monomers, (3) mixing the aqueous dispersion with the monomer mixture, and (4) polymerizing the monomers.

In an embodiment, the monomers are polymerized by suspension polymerization.

The individual steps of the method according to the present invention will be explained below.

(1) Preparation of Aqueous Dispersion

First, colloidal silica is added to an aqueous medium. The colloidal silica is used in an amount of 5 to 15 parts by weight, based on 100 parts by weight of all monomers used. If the amount of the colloidal silica is less than 5 parts by weight, a mixture of the monomers is not dispersed into microdroplets in a subsequent homogenization process and becomes unstable. Meanwhile, the use of the colloidal silica in an amount exceeding 15 parts by weight renders the aqueous medium viscous. This increased viscosity leads to a broad size distribution of microdroplets composed of the monomer mixture in a subsequent homogenization process, and as a result, the volume average particle diameter/number average particle diameter ratio (dv/dp) of a final toner is undesirably increased above 1.5. In this case (i.e. dv/dp>1.5), the amount of the toner consumed increases and non-uniform images are obtained during printing. Thereafter, a polyvinylpyrrolidone is added to prepare an aqueous dispersion. The polyvinylpyrrolidone is used in an amount of 1 to 3 parts by weight, based on 100 parts by weight of all monomers used. The use of the polyvinylpyrrolidone in an amount of less than 1 part by weight makes aggregation of the colloidal silica serving as a dispersant difficult. Meanwhile, the polyvinylpyrrolidone exceeding 3 parts by weight remains after aggregation with the colloidal silica to act as an independent dispersant, leading to the formation of toner particles whose size is much smaller than expected.

The colloidal silica preferably has a volume average particle diameter (dv) of 10 to 30 nm and a volume average particle diameter/number average particle diameter ratio (dv/dp) lower than 1.5. If the volume average particle diameter (dv) of the colloidal silica is smaller than 10 nm, the resulting polyvinylpyrrolidone/colloidal silica aggregates have a size smaller than expected. Hence, the use of colloidal silica having a volume average particle diameter (dv) smaller than 10 nm as a dispersant leads to the formation of toner particles having a size smaller than expected. Meanwhile, if the volume average particle diameter (dv) of the colloidal silica is greater than 30 nm, the resulting polyvinylpyrrolidone/colloidal silica aggregates have a size larger than expected. Hence, the use of colloidal silica having a volume average particle diameter (dv) greater than 30 nm as a dispersant leads to the formation of toner particles having a size larger than expected. If the ratio dv/dp of the colloidal silica is 1.5 or greater, the size distribution of the colloidal silica in the resulting polyvinylpyrrolidone/colloidal silica aggregates is broad. This broad size distribution of the colloidal silica leads to a broad size distribution of microdroplets composed of the monomer mixture in a subsequent homogenization process, eventually resulting in an undesirably high dv/dp (>1.5) of final toner particles.

The polyvinylpyrrolidone preferably has a molecular weight of 20,000 to 60,000. If the polyvinylpyrrolidone having a molecular weight lower than 20,000 is used, the colloidal silica does not readily aggregate. Meanwhile, if the polyvinylpyrrolidone having a molecular weight higher than 60,000 is used, the colloidal silica readily aggregates before polymerization but the colloidal silica aggregates are not dispersed at a high pH after polymerization, causing a difficulty in washing.

Then, the pH of the aqueous dispersion is adjusted within the range of 2 and 3 by the addition of hydrochloric acid (HCl).

The aqueous dispersion may contain polyvinylpyrrolidone/colloidal silica aggregates having a diameter smaller than 100 nm in an amount of 1% by weight or less, based on the total weight of all aggregates.

The colloidal silica and the polyvinylpyrrolidone begin to aggregate when hydrochloric acid is added to the aqueous dispersion with stirring at a high speed until pH≦2. After the aqueous dispersion of the colloidal silica and the polyvinylpyrrolidone is stirred at 11,000 rpm and left standing for about 10 minutes, the supernatant is decanted to remove colloidal silica/polyvinylpyrrolidone aggregates having a size smaller than 100 nm from the aqueous dispersion. The supernatant accounts for 40 to 60 parts by weight and preferably 50 parts by weight, based on 100 parts by weight of the aqueous dispersion. By the removal of the supernatant, the amount of the colloidal silica/polyvinylpyrrolidone aggregates having a diameter smaller than 100 nm in the aqueous dispersion is limited to 1% by weight or less, based on the total weight of all aggregates.

Emulsion particles having a size smaller than 0.5 μm may be undesirably created if the aqueous dispersion contains colloidal silica/polyvinylpyrrolidone aggregates having a diameter smaller than 100 nm in an amount of more than 1% by weight.

Toner particles having a uniform size can be produced when the ratio dv/dp of the colloidal silica/polyvinylpyrrolidone aggregates is 1.5 or less.

(2) Preparation of Monomer Mixture

In this step, a mixture of monomers is prepared.

Examples of monomers suitable for use in the present invention include aromatic vinyl monomers, acrylate monomers, methacrylate monomers, diene monomers, and mixtures thereof. Optionally, the monomer mixture may further include an acidic or basic olefin monomer.

Specifically, the monomer mixture includes 30 to 95 parts by weight of an aromatic vinyl monomer, 5 to 70 parts by weight of at least one monomer selected from the group consisting of acrylate, methacrylate and diene monomers, 1 to 20 parts by weight of a pigment, 0.1 to 30 parts by weight of a wax, 0.001 to 10 parts by weight of a crosslinking agent, 0.1 to 20 parts by weight of a charge control agent, and 0.001 to 8 parts by weight of a molecular weight modifier, based on 100 parts by weight of all monomers used.

Optionally, the monomer mixture may further include 0.1 to 30 parts by weight of an acidic or basic olefin monomer, based on 100 parts by weight of all monomers used.

1 to 60 parts by weight of the monomer mixture is mixed with 100 parts by weight of the aqueous dispersion to obtain a mixed solution.

The monomer mixture is polymerized while applying a shear force to the mixed solution using a homogenizer to prepare toner cores.

If required, the monomer mixture may further include 0.01 to 10 parts by weight of at least one polar polymer selected from polyesters and styrene-acrylate polymers, based on 100 parts by weight of all monomers used.

As the aromatic vinyl monomer, there can be used, for example, styrene, monochlorostyrene, methylstyrene or dimethylstyrene. It is preferred to use the aromatic vinyl monomer in an amount of 30 to 95 parts by weight, based on 100 parts by weight of all monomers used.

As the acrylate monomer, there can be used, for example, methyl acrylate, ethyl acrylate, n-butyl acrylate, isobutyl acrylate, dodecyl acrylate or 2-ethylhexyl acrylate. As the methacrylate monomer, there can be used, for example, methyl methacrylate, ethyl methacrylate, n-butyl methacrylate, isobutyl methacrylate, dodecyl methacrylate or 2-ethylhexyl methacrylate. As the diene monomer, there can be used, for example, butadiene or isoprene. At least one monomer selected from the acrylate, methacrylate and diene monomers is preferably used in an amount of 5 to 70 parts by weight, based on 100 parts by weight of all monomers used.

As the acidic olefin monomer, for example, an α,β-ethylenically unsaturated compound having at least one carboxyl group may be used. As the basic olefin monomer, there can be used, for example, a methacrylic acid ester, a methacrylamide, a vinylamine or a diallylamine of an aliphatic alcohol having at least one group selected from amine and quaternary ammonium groups, or an ammonium salt thereof.

It is preferred to use at least one olefin monomer selected from the acidic and basic olefin monomers in an amount of 0.1 to 30 parts by weight, based on 100 parts by weight of all monomers used.

The wax may be selected from: petroleum waxes, such as paraffin wax, microcrystalline wax and ceresin wax; natural waxes, such as carnauba wax; synthetic waxes, such as ester wax, polyethylene wax and polypropylene wax; and mixtures thereof. It is preferred to use the wax in an amount of 0.1 to 30 parts by weight, based on 100 parts by weight of all monomers used.

The molecular weight modifier may be selected from mercaptan compounds, such as t-dodecyl mercaptan and n-dodecyl mercaptan, and mixtures thereof. It is preferred to use the molecular weight modifier in an amount of 0.001 to 8 parts by weight, based on 100 parts by weight of all monomers used.

As the pigment, there can be used: an inorganic pigment selected from metal powder, metal oxide, carbon, sulfide, chromate and ferrocyanide pigments; an organic pigment selected from azo dye, acidic dye, basic dye, mordant dye, phthalocyanine, quinacridone and dioxane pigments; or a mixture thereof. It is preferred to use the pigment in an amount of 1 to 20 parts by weight, based on 100 parts by weight of all monomers used.

As the charge control agent, there can be used: a cationic charge control agent, such as a higher aliphatic metal salt, an alkoxyamine, a chelate, a quaternary ammonium salt, an alkylamide, a fluorinated activator or a naphthenic acid metal salt; an anionic charge control agent, such as chlorinated paraffin, a chlorinated polyester, an acid group-containing polyester, a sulfonylamine of copper phthalocyanine or a styrene-acrylate polymer having sulfonic acid groups; or a mixture thereof. It is preferred to use the charge control agent in an amount of 0.1 to 20 parts by weight, based on 100 parts by weight of all monomers used.

As the crosslinking agent, there can be used, for example, divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine or tetraallyloxyethane. It is preferred to use the crosslinking agent in an amount of 0.001 to 10 parts by weight, based on 100 parts by weight of all monomers used.

The monomer mixture may further include a reaction initiator. The reaction initiator may be soluble in oil or water. Specific examples of the reaction initiator include: azo initiators, such as azobisisobutyronitrile and azobisvaleronitrile;

organic peroxides, such as benzoyl peroxide and lauroyl peroxide; and water-soluble initiators commonly used in the art, such as potassium persulfate and ammonium persulfate. The reaction initiator is preferably used in an amount of 0.01 to 5.00 parts by weight and more preferably 0.1 to 2.0 parts by weight, based on 100 parts by weight of all monomers used.

(3) Suspension Polymerization

The monomer mixture is homogenized with the aqueous dispersion under a shear force using a homogenizer before polymerization. The monomers are polymerized under suspension polymerization conditions well known in the art to produce a toner.

(4) Removal of the Colloidal Silica and Polyvinylpyrrolidone

The dispersant is separated from the solution containing the polymerized toner by a suitable method. When a 0.05 to 0.2 N aqueous NaOH solution is added to the solution to raise the pH above 5, the colloidal silica aggregates as aqueous dispersants are separated from the toner surface and dispersed in the aqueous medium. Suitable equipment, such as a filter or a filter press, is used to separate the colloidal silica aggregates from the toner and clean the toner.

MODE FOR INVENTION

Hereinafter, the present invention will be explained in more detail with reference to the following examples. However, these examples are not intended to limit the scope of the present invention.

EXAMPLES

Example 1

Production of Polymerized Toner 10 parts by weight of colloidal silica (particle diameter=20 nm, dv/dp=1.2) as a dispersant was dispersed in 400 parts by weight of ion-exchange water at room temperature, and then 2 parts by weight of a polyvinylpyrrolidone (molecular weight=30,000) was added thereto. After the mixture was stirred at room temperature for 10 minutes, HCl was added to adjust the pH to 3. The acidic mixture was heated to a reaction temperature of 70° C. and stirred for 20 minutes to prepare an aqueous dispersion.

Four parts by weight of allyl methacrylate as a crosslinking agent and 0.02 parts by weight of n-dodecyl mercaptan as a molecular weight modifier were added to a mixture of 160 parts by weight of styrene, 36 parts by weight of n-butyl acrylate and 4 parts by weight of acrylic acid as monomers. One part by weight of a styrene-acrylic polymer having sulfonic acid groups as a charge control agent was sufficiently dissolved in the monomer mixture, and 10 parts by weight of carbon black was added thereto. After the resulting mixture was stirred in a bead mill at 2,000 rpm for 2 hours, beads were removed to prepare 215.02 parts by weight of the mixture of the monomers and the pigment.

The mixture was heated to 70° C. in a water bath, and 5 parts by weight of paraffin wax was added thereto to prepare monomer mixture. The monomer mixture (200 parts by weight) is homogenized with the aqueous dispersion (800 parts by weight) under a shear force using a homogenizer before polymerization. The resulting mixture was allowed to react with stirring for 20 minutes. The reaction was continued with stirring using a paddle stirrer at 600 rpm for 15 hours to obtain a polymerized toner.

(Amount of the Toner Aggregates)

After the reaction mixture was passed through a 150-mesh filter, the filtered toner aggregates were dried and weighed.

(Centrifugal Cleaning)

A 0.1 N aqueous NaOH solution was added to the toner aggregates to separate the silica from the toner surface. The mixture was centrifuged using distilled water in a centrifuge (Beckman J2-21M, Rotor JA-14) at 3,000 rpm for 15 minutes. The supernatant was decanted away, and then the concentrate was dispersed in distilled water. The above procedure was repeated twice to remove the silica from the toner. Filtration was conducted to remove moisture. The toner cake was dried in a vacuum oven at room temperature for 48 hours to leave the toner.

(Size of the Toner Particles)

A Multisizer Coulter Counter was used to measure the size of the toner particles.

(Surface Treatment of the Toner Particles)

Two parts by weight of silica having a size of 10 nm was added to 100 parts by weight of the toner particles and stirred in a Henschel mixer at a high speed of 5,000 rpm for 7 minutes to adsorb the silica on the surface of the toner particles.

(Consumed Amount of the Toner)

The surface-treated toner was filled in a toner feeder of a printer cartridge (HP4600 Printer, Hewlett-Packard). The toner feeder filled with the toner was weighed before printing. Rectangles of 19 cm (w)×1.5 cm (l) were printed on 1,000 sheets of paper (A4 size). The amount of the toner consumed was determined as the difference in the weight of the toner feeder before and after printing on the 1,000 sheets of paper.

Example 2

A polymerized toner was produced in the same manner as in Example 1 except that a polyvinylpyrrolidone having a molecular weight of 40,000 was added. The results are shown in Table 1.

Example 3

A polymerized toner was produced in the same manner as in Example 1 except that colloidal silica having a particle diameter of 25 nm and a polyvinylpyrrolidone having a molecular weight of 40,000 were added to the aqueous dispersion medium. The results are shown in Table 1.

Example 4

A polymerized toner was produced in the same manner as in Example 1 except that 7 parts by weight of the colloidal silica and a polyvinylpyrrolidone having a molecular weight of 40,000 were added to the aqueous dispersion medium. The results are shown in Table 1.

Example 5

A polymerized toner was produced in the same manner as in Example 1 except that 12 parts by weight of the colloidal silica and a polyvinylpyrrolidone having a molecular weight of 40,000 were added to the aqueous medium. The results are shown in Table 1.

Example 6

A polymerized toner was produced in the same manner as in Example 1 except that one part by weight of a polyvinylpyrrolidone having a molecular weight of 40,000 was added. The results are shown in Table 1.

Example 7

A polymerized toner was produced in the same manner as in Example 1 except that 3 parts by weight of a polyvinylpyrrolidone having a molecular weight of 40,000 was added. The results are shown in Table 1.

Example 8

A polymerized toner was produced in the same manner as in Example 1 except that colloidal silica having a particle diameter of 15 nm and a polyvinylpyrrolidone having a molecular weight of 40,000 were added to the aqueous dispersion medium. The results are shown in Table 1.

Example 9

A polymerized toner was produced in the same manner as in Example 1 except that 15 parts by weight of colloidal silica having a particle diameter of 15 nm and a polyvinylpyrrolidone having a molecular weight of 40,000 were added to the aqueous dispersion medium. The results are shown in Table 1.

Example 10

A polymerized toner was produced in the same manner as in Example 1 except that 12 parts by weight of colloidal silica having a particle diameter of 15 nm and one part by weight of a polyvinylpyrrolidone having a molecular weight of 40,000 were added to the aqueous dispersion medium. The results are shown in Table 1.

Comparative Example 1

A polymerized toner was produced in the same manner as in Example 1 except that 25 parts by weight of the colloidal silica was added to the aqueous dispersion medium. The results are shown in Table 1.

Comparative Example 2

A polymerized toner was produced in the same manner as in Example 1 except that colloidal silica having a particle diameter of 50 nm was added to the aqueous dispersion medium. The results are shown in Table 1.

Comparative Example 3

A polymerized toner was produced in the same manner as in Example 1 except that colloidal silica having a dv/dp of 1.7 was added to the aqueous dispersion medium. The results are shown in Table 1.

Comparative Example 4

A polymerized toner was produced in the same manner as in Example 1 except that 5 parts by weight of the polyvinylpyrrolidone was added. The results are shown in Table 1.

Comparative Example 5

A polymerized toner was produced in the same manner as in Example 1 except that a polyvinylpyrrolidone having a molecular weight of 10,000 was added. The results are shown in Table 1.

Comparative Example 6

A polymerized toner was produced in the same manner as in Example 1 except that a polyvinylpyrrolidone having a molecular weight of 100,000 was added. The results are shown in Table 1.

Comparative Example 7

A polymerized toner was produced in the same manner as in Example 1 except that 3 parts by weight of the colloidal silica was added. The results are shown in Table 1.

Comparative Example 8

A polymerized toner was produced in the same manner as in Example 1 except that colloidal silica having a particle diameter of 5 nm was added to the aqueous dispersion medium. The results are shown in Table 1.

Comparative Example 9

A polymerized toner was produced in the same manner as in Example 1 except that no polyvinylpyrrolidone was added. The results are shown in Table 1.

TABLE 1

| | Colloidal silica (part by weight) | Colloidal silica (size, nm) | Colloidal silica ($dv^{1)}/dp^{2)}$) | Polyvinyl-pyrrolidone (part by weight) | Polyvinyl-pyrrolidone ($M_w$) | Toner (dv) | Toner (dv/dp) | Amount (g) of toner aggregates | Amount (g) of toner consumed |
|---|---|---|---|---|---|---|---|---|---|
| Example 1 | 10 | 20 | 1.2 | 2 | 30,000 | 7.5 | 1.3 | 2 | 17 |
| Example 2 | 10 | 20 | 1.2 | 2 | 40,000 | 7.7 | 1.3 | 3 | 17.5 |
| Example 3 | 10 | 25 | 1.2 | 2 | 40,000 | 7.9 | 1.25 | 1 | 18 |
| Example 4 | 7 | 20 | 1.2 | 2 | 40,000 | 7.9 | 1.3 | 2 | 18 |
| Example 5 | 12 | 20 | 1.2 | 2 | 40,000 | 7.2 | 1.3 | 3 | 16.5 |
| Example 6 | 10 | 20 | 1.2 | 1 | 40,000 | 7.7 | 1.35 | 3 | 18 |
| Example 7 | 10 | 20 | 1.2 | 3 | 40,000 | 7.6 | 1.3 | 2.5 | 17 |
| Example 8 | 10 | 15 | 1.2 | 2 | 40,000 | 7.2 | 1.2 | 2 | 16.5 |
| Example 9 | 12 | 15 | 1.2 | 2 | 40,000 | 7.3 | 1.3 | 1 | 17 |
| Example 10 | 12 | 15 | 1.2 | 1 | 40,000 | 7.9 | 1.3 | 1 | 18 |
| Comparative Example 1 | 25 | 20 | 1.2 | 2 | 30,000 | 7.2 | 1.6 | 2 | 21 |
| Comparative Example 2 | 10 | 50 | 1.2 | 2 | 30,000 | 9.1 | 1.6 | 3 | 25 |
| Comparative Example 3 | 10 | 20 | 1.7 | 2 | 30,000 | 7.5 | 1.8 | 3 | 24 |

TABLE 1-continued

| | Colloidal silica (part by weight) | Colloidal silica (size, nm) | Colloidal silica ($dv^{1)}/dp^{2)}$) | Polyvinyl-pyrrolidone (part by weight) | Polyvinyl-pyrrolidone ($M_w$) | Toner (dv) | Toner (dv/dp) | Amount (g) of toner aggregates | Amount (g) of toner consumed |
|---|---|---|---|---|---|---|---|---|---|
| Comparative Example 4 | 10 | 20 | 1.2 | 5 | 30,000 | 6.9 | 1.9 | 2 | 22 |
| Comparative Example 5 | 10 | 20 | 1.2 | 2 | 10,000 | 7.3 | 2.0 | 3 | 21 |
| Comparative Example 6 | 10 | 20 | 1.2 | 2 | 100,000 | 8.1 | 1.8 | 5 | 22 |
| Comparative Example 7 | 3 | 20 | 1.2 | 2 | 30,000 | 9.5 | 12.0 | 10 | 30 |
| Comparative Example 8 | 10 | 5 | 1.2 | 2 | 30,000 | 5.5 | 1.5 | 20 | 21 |
| Comparative Example 9 | 10 | 20 | 1.2 | 0 | — | 10.5 | 2.5 | 15 | 31 |

Note
$dv^{1)}$Volume average particle diameter
$dp^{2)}$Number average particle diameter As can be seen from the results in Table 1, the toner particles produced in Examples 1-10 had preferred volume average particle diameters and narrow particle size distributions, and showed no partial aggregation during polymerization. In addition, the toner particles were consumed in small amounts during printing. Therefore, according to the method of the present invention, the need for centrifugation after polymerization is eliminated.

In the following examples, polymerized toners were produced using aqueous dispersions containing colloidal silica/polyvinylpyrrolidone aggregates having a diameter smaller than 100 nm in amounts of 1% by weight or less, based on the total weight of all aggregates.

Example 11

Production of Polymerized Toner 10 parts by weight of colloidal silica (particle diameter=20 nm, dv/dp=1.2) as a dispersant was dispersed in 400 parts by weight of ion-exchange water at room temperature, and then 2 parts by weight of a polyvinylpyrrolidone (molecular weight=30,000) was added thereto. After the mixture was stirred at 400 rpm at room temperature for 10 minutes, an aqueous HCl solution was added with stirring at 11,000 rpm to adjust the pH to 2. Thereafter, stirring was continued for 20 minutes to prepare an aqueous dispersion containing colloidal silica/polyvinylpyrrolidone aggregates. After the stirring was stopped, the aqueous dispersion was allowed to stand for 10 minutes. The supernatant corresponding to 50 parts by weight with respect to 100 parts by weight of the aqueous dispersion was decanted to remove colloidal silica/polyvinylpyrrolidone aggregates having a size smaller than 100 nm from the aqueous dispersion. The reaction temperature was raised to 60° C.

Four parts by weight of allyl methacrylate as a crosslinking agent and 0.02 parts by weight of n-dodecyl mercaptan as a molecular weight modifier were added to a mixture of 160 parts by weight of styrene, 36 parts by weight of n-butyl acrylate and 4 parts by weight of acrylic acid as monomers. One part by weight of a styrene-acrylic polymer having sulfonic acid groups as a charge control agent was sufficiently dissolved in the monomer mixture, and 10 parts by weight of carbon black was added thereto. After the resulting mixture was stirred in a bead mill at 2,000 rpm for 2 hours, beads were removed to prepare 215.02 parts by weight of the mixture of the monomers and the pigment.

The mixture thus prepared was mixed with the aqueous dispersion to obtain a mixed solution. The mixed solution was heated to 70° C. in a water bath, and 5 parts by weight of paraffin wax was added thereto. The resulting mixture was allowed to react with stirring for 20 minutes. The reaction was continued with stirring using a paddle stirrer at 600 rpm for 15 hours to obtain a polymerized toner.

(Amount of Emulsion Particles)

After the reaction mixture was left standing for one day, toner particles having a size of 5-10 μm were separated from emulsion particles having a size smaller than 0.5 μm by precipitation. Thereafter, the supernatant was collected, dried, and weighed to determine the proportion of the emulsion particles in the total weight of the reaction mixture.

(Centrifugal Cleaning)

A 0.1 N aqueous NaOH solution was added to the toner to separate the silica from the toner surface. The mixture was centrifuged using distilled water in a centrifuge (Beckman J2-21M, Rotor JA-14) at 3,000 rpm for 15 minutes. The supernatant was decanted away, and then the concentrate was dispersed in distilled water. The above procedure was repeated twice to remove the silica from the toner. Filtration was conducted to remove moisture. The toner cake was dried in a vacuum oven at room temperature for 48 hours to leave the toner.

(Size of the Colloidal Silica/Polyvinylpyrrolidone Aggregates and the Toner Particles)

A Multisizer Coulter Counter was used to measure the size of the colloidal silica/polyvinylpyrrolidone aggregates and the toner particles.

(Surface Treatment of the Toner Particles)

Two parts by weight of silica having a size of 10 nm was added to 100 parts by weight of the toner particles and stirred in a Henschel mixer at a high speed of 5,000 rpm for 7 minutes to adsorb the silica on the surface of the toner particles.

(Consumed Amount of the Toner)

The surface-treated toner was filled in a toner feeder of a printer cartridge (HP4600 Printer, Hewlett-Packard). The toner feeder filled with the toner was weighed before printing. Rectangles of 19 cm (w)×1.5 cm (l) were printed on 1,000 sheets of paper (A4 size). The toner feeder was weighed after printing. The amount of the toner consumed was determined as the difference in the weight of the toner feeder before and after printing on the 1,000 sheets of paper.

Example 12

A polymerized toner was produced in the same manner as in Example 11 except that a polyvinylpyrrolidone having a molecular weight of 40,000 was added. The results are shown in Table 2.

Example 13

A polymerized toner was produced in the same manner as in Example 11 except that colloidal silica having a particle diameter of 25 nm and a polyvinylpyrrolidone having a molecular weight of 40,000 were added to the aqueous dispersion medium. The results are shown in Table 2.

Example 14

A polymerized toner was produced in the same manner as in Example 11 except that 7 parts by weight of the colloidal silica and a polyvinylpyrrolidone having a molecular weight of 40,000 were added to the aqueous dispersion medium. The results are shown in Table 2.

Example 15

A polymerized toner was produced in the same manner as in Example 11 except that 12 parts by weight of the colloidal silica and a polyvinylpyrrolidone having a molecular weight of 40,000 were added to the aqueous dispersion medium. The results are shown in Table 2.

Comparative Example 10

A polymerized toner was produced in the same manner as in Example 11 except that colloidal silica/polyvinylpyrrolidone aggregates having a size smaller than 100 nm were not separated. The results are shown in Table 2.

Comparative Example 11

A polymerized toner was produced in the same manner as in Example 11 except that colloidal silica/polyvinylpyrrolidone aggregates having a size smaller than 100 nm were not sufficiently separated and their proportion was 5% by weight with respect to the total weight of all aggregates. The results are shown in Table 2.

As can be seen from the results in Table 2, the toner particles produced in Examples 11-15 had preferred volume average particle diameters and narrow particle size distributions. In addition, few emulsion particles were created and the toner particles were consumed in small amounts during printing.

The invention claimed is:

1. A method for producing a toner, comprising (1) preparing an aqueous dispersion containing polyvinylpyrrolidone/colloidal silica aggregates having a diameter smaller than 100 nm in an amount of 1% or less by weight based on a total weight of all aggregates by dispersing a polyvinylpyrrolidone and colloidal sillica in an aqueous medium, stirring the aqueous medium of the polyvinylpyrrolidone and the colloidal sillica at 11,000 rpm, leaving to stand for about 10 minutes, and removing supernatant;

(2) preparing a mixture of monomers;

(3) homogenizing the mixture of monomers in the aqueous dispersion to disperse the mixture of monomers in the aqueous dispersion in a form of microdroplets; and (4) polymerizing the mixture of monomers dispersed in the aqueous dispersion.

2. The method according to claim 1, wherein the supernatant is present in an amount of to 60 parts by weight, based on 100 parts by weight of the aqueous dispersion.

3. The method according to claim 1, wherein the colloidal silica has a volume average particle diameter (dv) of 10 to 30 nm and a volume average particle diameter/number average particle diameter ratio (dv/dp) lower than 1.5.

4. The method according to claim 1, wherein the polyvinylpyrrolidone has a molecular weight of 20,000 to 60,000.

5. The method according to claim 1, wherein the colloidal silica is used in an amount of to 15 parts by weight, based on 100 parts by weight of the monomers used in step (2).

6. The method according to claim 1, wherein the polyvinylpyrrolidone is used in an amount of to 3 parts by weight, based on 100 parts by weight of the monomers used in step (2).

7. The method according to claim 1, further comprising removing the polyvinylpyrrolidone and the colloidal silica after step (4).

8. The method according to claim 7, wherein the polyvinylpyrrolidone and the colloidal silica are removed from a toner surface by adding to 0.05 to 0.2 N of aqueous NaOH solution.

TABLE 2

| | Colloidal silica (part by weight) | Colloidal silica (size, nm) | Colloidal silica ($dv^{1)}/dp^{2)}$) | Polyvinyl-pyrrolidone (part by weight) | Polyvinyl-pyrrolidone ($M_w$) | 3) | 4) | 5) | Toner (dv) | Toner (dv/dp) | Emulsion particles (wt %) | Amount of toner consumed (g) |
|---|---|---|---|---|---|---|---|---|---|---|---|---|
| Example 11 | 10 | 20 | 1.2 | 2 | 30,000 | 500 | 0 | 1.3 | 7.5 | 1.3 | 1 | 17 |
| Example 12 | 10 | 20 | 1.2 | 2 | 40,000 | 520 | 0 | 1.3 | 7.7 | 1.3 | 2 | 17.5 |
| Example 13 | 10 | 25 | 1.2 | 2 | 40,000 | 550 | 0.5 | 1.35 | 7.9 | 1.25 | 1.5 | 18 |
| Example 14 | 7 | 20 | 1.2 | 2 | 40,000 | 450 | 0.1 | 1.25 | 7.9 | 1.3 | 2 | 18 |
| Example 15 | 12 | 20 | 1.2 | 2 | 40,000 | 570 | 0.2 | 1.35 | 7.2 | 1.3 | 2 | 16.5 |
| Comparative Example 10 | 10 | 20 | 1.2 | 2 | 30,000 | 310 | 10 | 1.5 | 6.8 | 1.5 | 9 | 25 |
| Comparative Example 11 | 10 | 20 | 1.2 | 2 | 30,000 | 350 | 5 | 1.45 | 6.9 | 1.6 | 5 | 27 |

Note $dv^{1)}$: Volume average particle diameter $dp^{2)}$: Number average particle diameter 3): Average particle diameter (nm) of silica/polyvinylpyrrolidone aggregates 4): Proportion (wt %) of silica/polyvinylpyrrolidone aggregates having a diameter smaller than 100 nm with respect to the total weight of all aggregates 5): dv/dp of silica/polyvinylpyrrolidone aggregates

9. The method according to claim 1, wherein the mixture of monomers comprises 30 to 95 parts by weight of an aromatic vinyl monomer, to 70 parts by weight of at least one monomer selected from the group consisting of acrylate, methacrylate and diene monomers, to 20 parts by weight of a pigment, 0.1 to 30 parts by weight of a wax, 0.001 to 10 parts by weight of a crosslinking agent, 0.1 to 20 parts by weight of a charge control agent, and to 8 parts by weight of a molecular weight modifier, based on 100 parts by weight of the monomers used in step (2); and wherein the mixture of monomers is used in an amount of to 60 parts by weight, based on 100 parts by weight of the aqueous dispersion.

10. The method according to claim 9, wherein the mixture of monomers further comprises 0.01 to 10 parts by weight of at least one polar polymer selected from polyesters and styrene-acrylate polymers, based on 100 parts by weight of the monomers used in step (2).

11. The method according to claim 9, wherein the mixture of monomers further comprises 0.1 to 30 parts by weight of an acidic or basic olefin monomer, based on 100 parts by weight of the monomers used in step (2).

12. The method according to claim 9, wherein the aromatic vinyl monomer is at least one selected from the group consisting of styrene, monochlorostyrene, methylstyrene and dimethylstyrene.

13. The method according to claim 9, wherein the acrylate monomer is at least one selected from the group consisting of methyl acrylate, ethyl acrylate, n-butyl acrylate, isobutyl acrylate, dodecyl acrylate and 2-ethylhexyl acrylate; the methacrylate monomer is selected from the group consisting of methyl methacrylate, ethyl methacrylate, n-butyl methacrylate, isobutyl methacrylate, dodecyl methacrylate and 2-ethylhexyl methacrylate; and the diene monomer is at least one selected from the group consisting of butadiene and isoprene.

14. The method according to claim 9, wherein the wax includes at least one selected from the group consisting of paraffin wax, microcrystalline wax, ceresin wax, carnauba wax, ester wax, polyethylene wax and polypropylene wax.

15. The method according to claim 9, wherein the molecular weight modifier includes at least one selected from the group consisting of t-dodecyl mercaptan and n-dodecyl mercaptan.

16. The method according to claim 9, wherein the pigment is selected from the group consisting of a metal powder pigment, a metal oxide pigment, a carbon pigment, a sulfide pigment, a chromate pigment, a ferrocyanide pigment, an azo dye pigment, an acidic dye pigment, a basic dye pigment, a mordant dye pigment, a phthalocyanine pigment, a quinacridone pigment, a dioxane pigment and mixtures thereof.

17. The method according to claim 9, wherein the charge control agent is selected from the group consisting of higher aliphatic metal salts, alkoxyamines, chelates, quaternary ammonium salts, alkylamides, fluorinated activators, naphthenic acid metal salts chlorinated paraffin, chlorinated polyesters, acid group-containing polyesters, sulfonylamines of copper phthalocyanine, styrene-acrylate polymers having sulfonic acid groups and mixtures thereof.

18. The method according to claim 9, wherein the crosslinking agent is selected from the group consisting of divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine and tetraallyloxyethane.

19. The method according to claim 9, wherein the mixture of monomers further comprises 0.01 to 5 parts by weight of a reaction initiator, based on 100 parts by weight of the monomers used in step (2).

20. The method according to claim 19, wherein the reaction initiator is selected from the group consisting of azobisisobutyronitrile, azobisvaleronitrile, benzoyl peroxide, lauroyl peroxide, potassium persulfate and ammonium persulfate.

21. A method for producing a toner, comprising the steps of:

(1) dispersing a polyvinylpyrrolidone and colloidal silica in an aqueous medium to prepare an aqueous dispersion, wherein the polyvinylpyrrolidone has a weight average molecular weight of 20,000 to 60,000, and the colloidal silica has a volume average particle diameter (dv) of 10 nm to 30 nm and a volume average particle diameter/number average particle diameter ratio (dv/dp) lower than 1.5;

(2) preparing a mixture of monomers;

(3) homogenizing the mixture of monomers in the aqueous dispersion to disperse the mixture of monomers in the aqueous dispersion in a form of microdroplets; and (4) polymerizing the dispersed monomer mixture in step (3).

* * * * *